US005103510A

United States Patent [19]

Thurow

[11] Patent Number: 5,103,510

[45] Date of Patent: Apr. 14, 1992

[54] LOCKING LINKAGE FOR SOFA BED

[75] Inventor: Jerry A. Thurow, Dubuque, Iowa

[73] Assignee: Flexsteel Industries, Inc., Dubuque,, Iowa

[21] Appl. No.: 643,543

[22] Filed: Jan. 18, 1991

[51] Int. Cl.[5] ..... A47C 17/17

[52] U.S. Cl. ..... 5/37.1; 5/41; 5/47; 5/55.1

[58] Field of Search ..... 5/37.1, 41, 47, 48, 5/55.1; 297/85

[56] References Cited

U.S. PATENT DOCUMENTS

| | | | |
|---|---|---|---|
| 3,302,969 | 2/1967 | Mizelle et al. . | |
| 3,657,747 | 4/1972 | Rogers, Jr. et al. . | |
| 3,850,475 | 11/1974 | Katz et al. . | |
| 3,913,152 | 10/1975 | Quakenbush | 5/37.1 |
| 4,000,529 | 1/1977 | De Maria . | |
| 4,001,901 | 1/1987 | Quakenbush | 5/37.1 |
| 4,131,960 | 1/1979 | Quakenbush . | |
| 4,200,941 | 5/1980 | Gill et al. . | |
| 4,307,912 | 12/1981 | Watt et al. . | |
| 4,543,675 | 10/1985 | Shrock . | |
| 4,563,784 | 1/1986 | Shrock et al. . | |
| 4,569,093 | 2/1986 | Hermann . | |
| 4,601,074 | 7/1986 | Welsch et al. . | |
| 4,669,135 | 6/1987 | Gonzales . | |
| 4,750,222 | 6/1988 | Quakenbush | 5/37.1 |
| 4,996,730 | 3/1991 | Fireman et al. | 5/37.1 |

FOREIGN PATENT DOCUMENTS

| | | |
|---|---|---|
| 674115 | 11/1963 | Canada . |
| 195595 | 11/1906 | Fed. Rep. of Germany . |
| 1105722 | 1/1958 | France . |
| 1248754 | 2/1963 | France . |
| 954161 | 4/1964 | United Kingdom . |

*Primary Examiner*—Michael F. Trettel
*Attorney, Agent, or Firm*—Emrich & Dithmar

[57] ABSTRACT

A folding sofa bed includes a back, a seat and a forward extension moveable between a generally horizontal, planar array when in the bed configuration and a sofa configuration, wherein the seat and back are generally transverse and in generally horizontal and vertical orientations, respectively, and the forward extension is disposed below a forward edge of the seat portion in a retracted position. Pivoting linkage couples the back and seat as well as the seat and the forward extension, with locking linkage and stops provided for (1) maintaining the extension in the extended, upraised position; (2) maintaining the seat and back in the horizontal, planar configuration; and (3) maintaining the seat and back in fixed relative orientation when in the sofa configuration. The folding sofa bed is easily moveable between the two configurations by merely grasping and moving a forward edge of the seat in an upward, forward direction for the bed configuration or in a upward, rearward direction for the sofa configuration, with the forward extension also easily moveable between the two configurations. A pair of legs automatically deploy when the sofa bed is folded to the bed configuration to provide support for a forward portion of the seat as well as for the forward extension.

20 Claims, 6 Drawing Sheets

LOCKING LINKAGE FOR SOFA BED

BACKGROUND OF THE INVENTION

This invention relates generally to pull-out sofa beds and is particularly directed to locking linkage for a foldable pull-out sofa bed.

Foldable couch/bed combinations frequently referred to as sofa beds, generally include moveable seat and back portions which can be folded to a seating configuration and unfolded to a horizontal, generally planar reclined configuration for use as a bed. Suitable linkage is provided for pivotally coupling the seat and back portions. In some sofa beds, the seat portion of the sofa unfolds outward from the back portion which remains fixed in position, with the distal end of the thus unfolded seat portion supported by unfolding legs. In others, the back portion of the sofa reclines to provide, with the seat portion, a pair of generally flat, aligned support surfaces. Other approaches make use of extendable/retractable frame extensions at either the head or foot portion of the unfolded configuration to provide additional support surface area.

To date, folding sofa bed combinations have suffered from various shortcomings. For example, the absence of means for locking the unfolded assembly in the bed configuration allows the flat support surface to be easily rendered non-planar when weight is concentrated on a relatively small surface area, particularly along a median axis of the bed such as between the unfolded seat and back portions thereof. Those sofa beds which require unfolding of the seat portion by pulling up on an aft, inner portion of the seat require considerable strength for unfolding. This precludes use of this type of folding sofa bed by the handicapped, feeble or those of advancing age. Finally, presently available pivoting linkage for folding sofa bed combinations is generally complicated and makes use of a large number of components which increases its cost and reduces its reliability and limits its usable lifetime.

The present invention addresses the aforementioned limitations of the prior art by providing a folding sofa bed which includes back, seat and extension portions moveable between a generally horizontal, planar array when in the bed configuration and a sofa configuration, wherein the back is oriented generally vertical and the seat generally horizontal, with the extension portion retracted to a position below a forward edge of the seat. Suitable coupling linkage allows for folding the back, seat and extension portions between the sofa and seat configurations and for maintaining the three aforementioned components in locked, or rigidly fixed, position when in either configuration.

OBJECTS AND SUMMARY OF THE INVENTION

Accordingly, it is an object of the present invention to provide an improved folding sofa bed combination, and coupling linkage therefor.

Another object of the present invention is to provide coupling linkage for a foldable sofa bed assembly which securely locks the assembly in a planar, generally horizontal support configuration for use as a bed, while permitting the assembly to be easily re-configured to a sofa.

Yet another object of the present invention is to facilitate moving a folding sofa bed between the two configurations by grasping and displacing a forward edge portion of the seat either upward and forward for the bed or upward and rearward for the sofa.

A further object of the present invention is to provide flexible linkage for a folding sofa bed which is simple, reliable, of modest cost, and employs few moving parts.

A still further object of the present invention is to provide for the automatic deployment in a foldable sofa bed of support legs, and secure locking of the moveable support elements in position, for more stable and secure positioning in the bed configuration.

It is another object of the present invention to provide a reclining sofa construction with its back rest, seat and leg rest portions moveable to substantially horizontally aligned, fully reclined positions.

Yet another object of the present invention is to provide improved linkage for a folding sofa bed which is of simple construction, easy to manufacture and produce, commercially feasible, long lasting, and relatively trouble-free in operation.

Another object of the present invention is to provide a foldable sofa bed which can easily be reconfigured from the sofa to the bed configuration without first moving the sofa bed away from a wall positioned immediately aft of the sofa bed.

This invention contemplates a sofa bed comprising: support means for supporting the sofa bed; a back frame pivotally coupled to the support means and moveable between a generally upright position and a reclined position; a seat frame pivotally coupled to the support means and to the back frame and moveable between an inclined orientation with the back frame generally upright to form a sofa and a horizontal orientation with the back frame reclined to form a bed; a forward extension; and locking linkage coupling the forward extension to the seat frame for pivotally displacing the forward extension between a horizontal orientation in alignment with the seat and back frames when in a bed configuration, and a generally vertical orientation below the frame in a sofa configuration, wherein the locking linkage includes first and second lock links pivotally coupled to the seat frame and wherein the first lock link includes a first end coupled to the forward extension and a second end having notch means for engaging the second lock link and preventing pivoting displacement of the first lock link so as to lock the forward extension in horizontal alignment with the seat and back frames.

This invention further contemplates a sofa bed comprising: support means for supporting the sofa bed; a back frame pivotally coupled to the support means and moveable between a generally upright position and a generally horizontal, reclined position; a seat frame pivotally coupled to the support means and moveable between an aft, inclined position and a forward, horizontal position aligned with the reclined back frame; and linkage coupling the back and seat frames for moving the back frame to the generally upright position when the seat frame is moved to the aft inclined position and for moving the back frame to the horizontal, reclined position when the seat frame is moved to the forward, horizontal position, the linkage including locking means for locking the back and seat frames in the horizontal aligned position.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
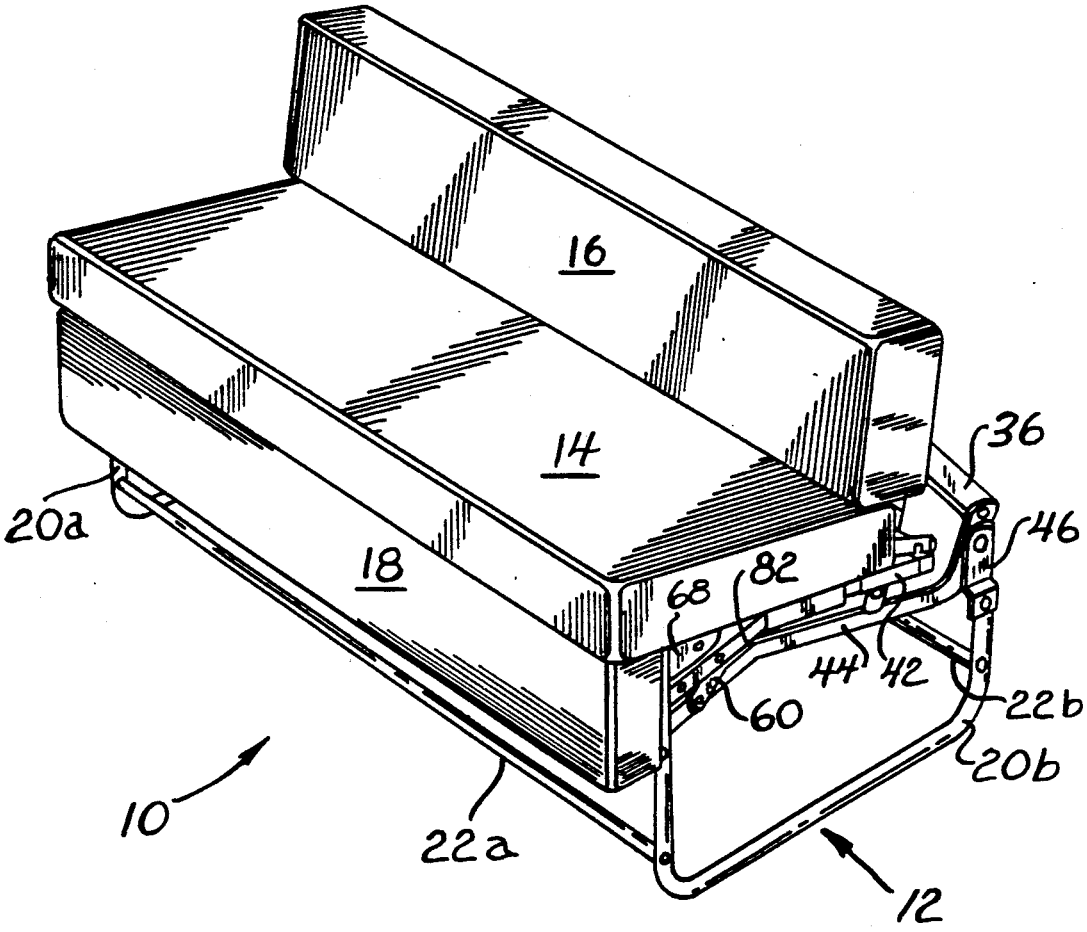
FIG. 1 is an upper perspective view of a sofa bed incorporating locking linkage in accordance with the present invention.
Figure 2:
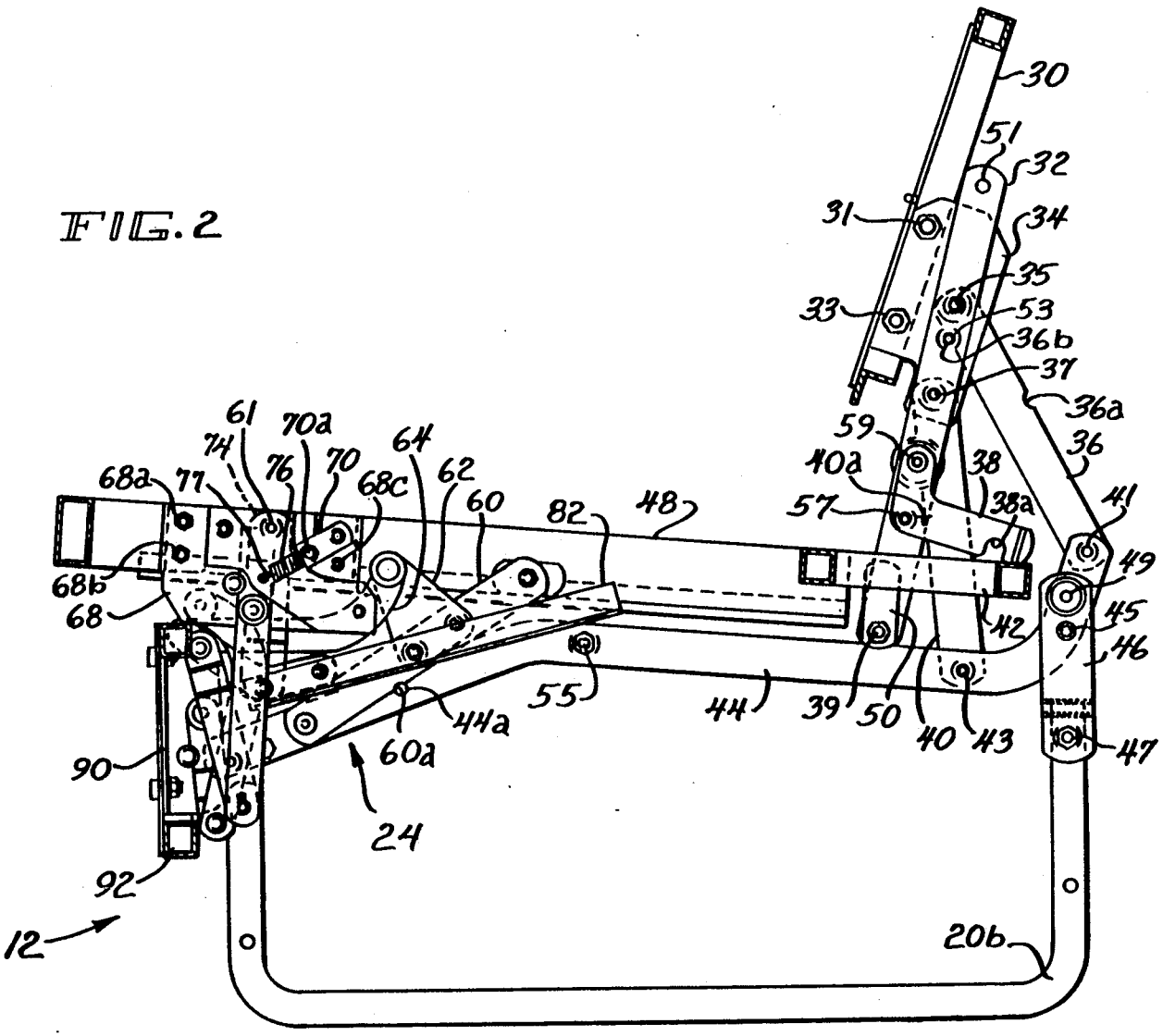
FIG. 2 is a side elevation view shown partially in phantom of a locking linkage arrangement for a folding sofa bed shown in the sofa configuration in accordance with the principles of the present invention.
Figure 2A:
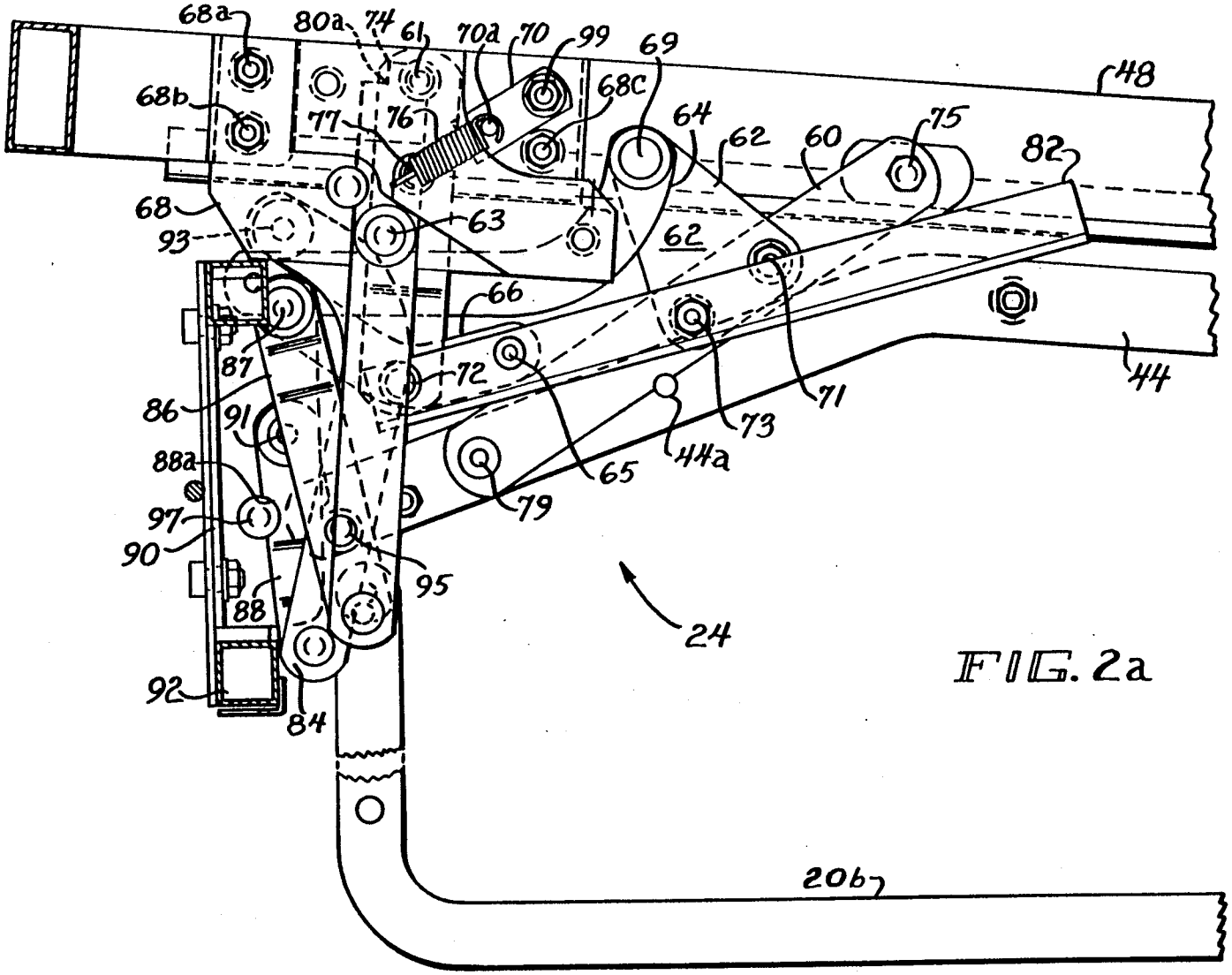
FIG. 2*a* is an enlarged view of a forward portion of the locking linkage arrangement shown in FIG. 2 illustrating details of the front extension support and locking linkage.

Referring to FIG. 1, there is shown an upper perspective view of a folding sofa bed 10 incorporating a locking linkage arrangement 12 in accordance with the principles of the present invention. A side elevation view shown partially in phantom of the locking linkage arrangement 12 is shown in FIG. 2. FIG. 2*a* is an enlargement of a forward portion of FIG. 2 showing details of a front extension support and locking mechanism 24 in accordance with one aspect of the present invention.

The folding sofa bed 10 includes a seat cushion 14, a back cushion 16 and a leg/feet cushion 18. When in the sofa configuration as shown in FIG. 1, the seat cushion 14 is generally horizontal, and the back cushion 16 and leg/feet cushion 18 are generally vertical. Each of the aforementioned cushions has an associated support or attachment structure, as described below. Thus, as shown in FIG. 2, a back frame 30 is provided for engaging and supporting the back cushion 16, while a seat frame 48 is provided for supporting the seat cushion 14. An extension frame 92 is provided for attachment to and supporting the leg/feet cushion 18. Each of the aforementioned back, seat and extension frames 30, 48 and 92 is moveable relative to one another for assuming the bed configuration, wherein these frame members are aligned in a generally planar array as described in detail below.

First and second legs 20*a*, 20*b* are coupled to and extend downward from the support frame of the folding sofa bed 10. Front and rear cross members 22*a* and 22*b* are connected between the generally U-shaped legs 20*a* and 20*b*. A front extension support and locking mechanism 24 is provided for the front extension frame 92 and a locking arrangement 38*a* (FIG. 3) is provided for maintaining the back and seat frames 30, 48 securely in position when in the bed configuration. Both of these locking arrangements are described in detail below. In the following discussion only one half of the coupling linkage is described, it being understood that similar coupling linkage connects the other ends of the back frame 30, the seat frame 48 and the front extension frame 92.

The locking linkage arrangement 12 includes the back frame 30 coupled by means of a pair of mounting bolts 31 and 33 to a coupling bracket 34. The coupling bracket 34 is, in turn, coupled to a first pivoting back link 32 by means of coupling pins 35 and 37. The coupling pins 35, 37 rigidly attach the back frame 30 and coupling bracket 34 combination to the first pivoting back link 32. One end of the first pivoting back link 32 is coupled via a pivot pin 39 and a fixed pivot bracket 50 to an aft extension 42 of the seat frame 48. The fixed pivot bracket 50 is rigidly attached to the seat frame's aft extension 42 by conventional means such as a weldment. The pivot pin 39 permits the back frame 30 to be pivotally displaced relative to the seat frame 48.

Figure 3:
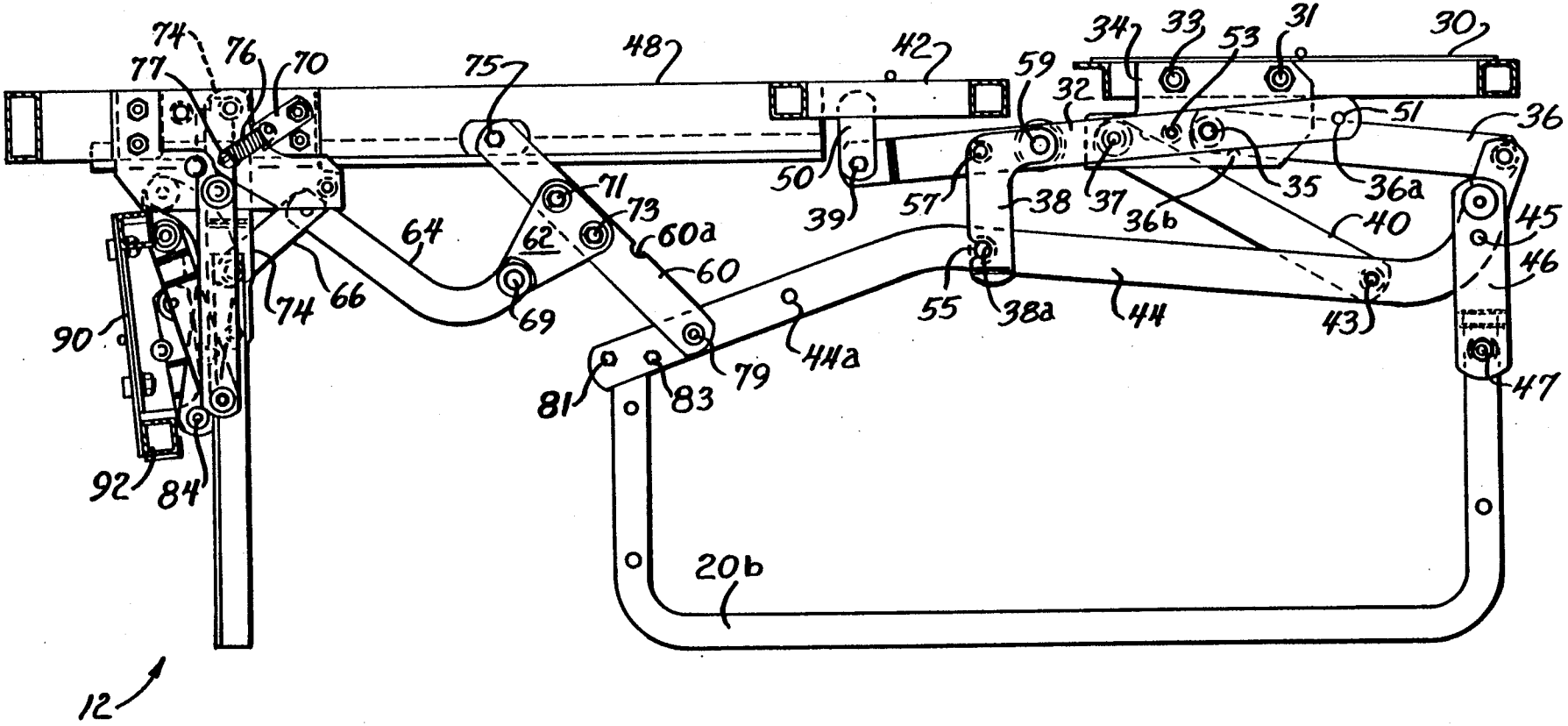
FIG. 3 is a side elevation view shown partially in phantom of the locking linkage arrangement of FIG. 2 shown in the reclined, or bed, configuration.
Figure 3A:
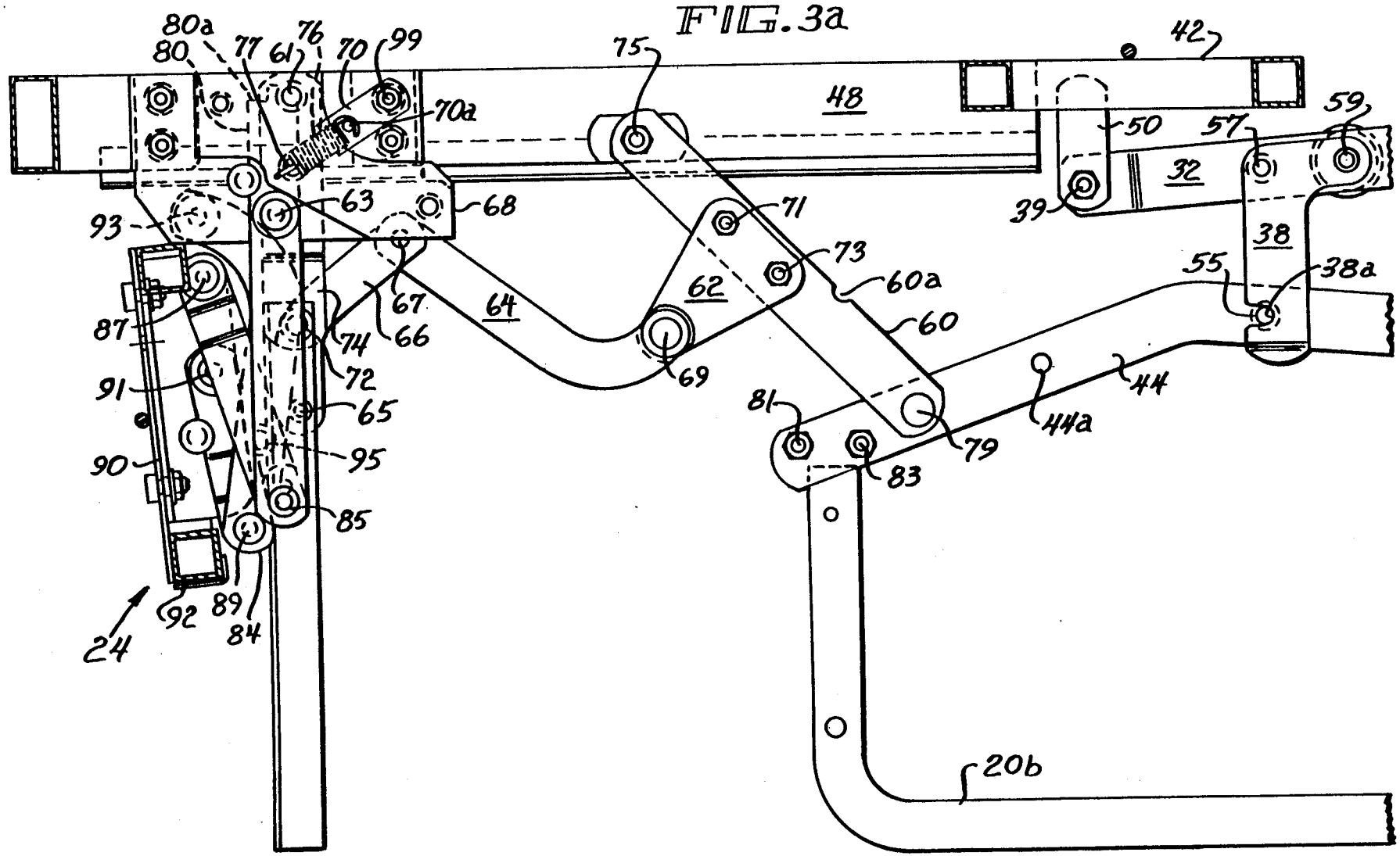
FIG. 3*a* is an enlarged view of a forward portion of the locking linkage arrangement in the configuration of FIG. 3 illustrating additional details thereof, with the forward extension retracted.

Coupling bracket 34 is also coupled by means of pivot pin 35 to one end of a second pivoting backlink 36. The other end of the second pivoting backlink 36 is pivotally coupled to the aft end of a carrier link 44 by means of pivot pin 41. Coupling bracket 34 is further pivotally coupled to one end of a third pivoting backlink 40 by means of pivot pin 37. A second end of the third pivoting backlink 40 is pivotally coupled to the carrier link 44 by means of pivot pin 43. A combination of the second and third pivoting backlinks 36, 40 pivotally coupled to the back frame 30 and coupling bracket 34 combination permits the back frame to be pivotally displaced downward relative to the fixed carrier link 44 as shown in FIG. 3 which illustrates the locking linkage arrangement 12 in the bed configuration. As the upper edge of back frame 30 is pivotally displaced rearward and urged in a downward direction, the first pivoting backlink 32 urges the seat frame 48 in a forward direction, or leftward as shown in FIG. 2. As the back frame 30 is pivotally rotated about pivot pin 39 in a clockwise direction, the second and third pivoting backlinks 36 and 40 are rotated in a counterclockwise direction about pivot pins 41 and 43, respectively. In the bed configuration, the second pivoting backlink 36 is oriented generally horizontal as shown in FIG. 3. An aft portion of the carrier link 44 is fixedly attached to an aft portion of the leg 20*b* by rear spacer 46 and bolts 45 and 47. Similarly, an upper end portion of the first pivoting backlink 32 is provided with a stop pin 51 for insertion in a notch 36*a* in an edge portion of the second pivoting backlink 36 when in the bed configuration. As the back frame 30 is lowered to the reclined position, counter-clockwise rotation of the second pivoting backlink 36 and clockwise rotation of the first pivoting backlink 32 causes the stop pin 51 to be positioned within the notch 36*a* of the second pivoting backlink as shown in FIG. 3. With the first and second pivoting backlinks 32, 36 oriented generally horizontally, the stop pin 51 is positioned within and engages the notch 36*a* in the second pivoting backlink to limit further downward movement of the back frame 30.

The second pivoting backlink 36 is provided with a second notch 36*b* which is located adjacent the upper end thereof when the folding sofa bed 10 is in the sofa configuration. The second notch 36*b* is adapted for receiving and engaging a stop pin 53 attached to the first pivoting backlink 32. Engagement by stop pin 53 of the second notch 36b in the second pivoting backlink 36 prevents aft displacement of the back frame 30 for securely maintaining the sofa bed 10 in the upright, sofa configuration shown in FIG. 2.

An L-shaped back latch 38 is attached to the first pivoting backlink 32 by means of mounting pins 57 and 59. In this manner, the L-shaped back latch 38 is securely attached in a fixed manner to the first pivoting backlink 32. The L-shaped back latch 38 includes a notch 38a therein for receiving and engaging a latch pin 55 attached to the carrier link 44. Insertion of the latch pin 55 in the notch 38a of the back latch 38 securely maintains the back frame 30 and seat frame 48 in generally horizontal alignment as shown in FIG. 3 when in the bed configuration. Rearward displacement of the seat frame 48 causes a corresponding rearward displacement of the L-shaped back latch 38 which is thereby disengaged from the latch pin 55 for unlocking the sofa bed 10 and allowing the sofa bed to be folded to the upright, sofa configuration shown in FIG. 2.

Figures 4, 5:
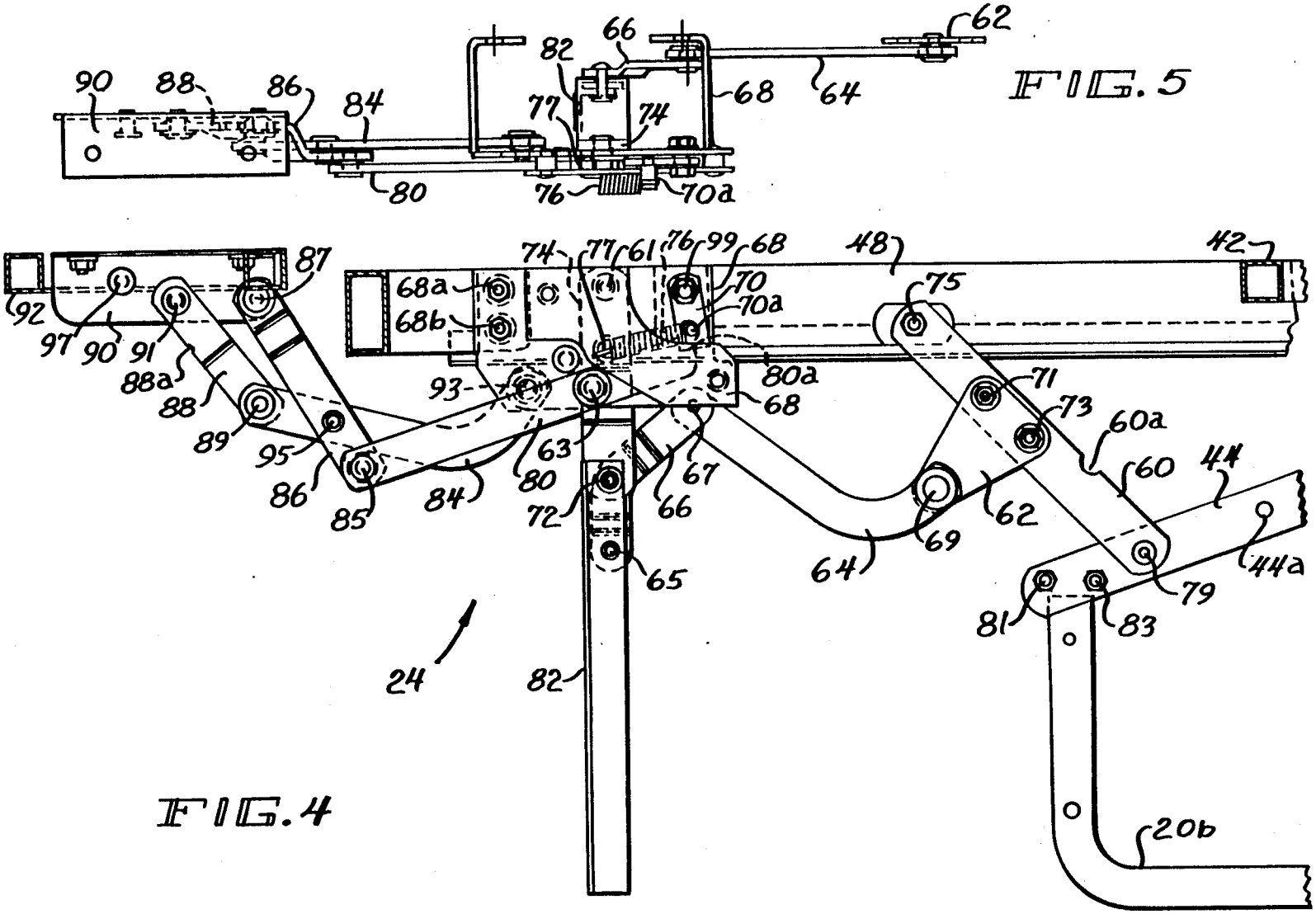
FIG. 4 is a side elevation view shown partially in phantom of a forward portion of the locking linkage arrangement in the unfolded configuration with the forward extension in the fully extended position.
FIG. 5 is a top plan view of the locking linkage arrangement as shown in FIG. 4.

Operation of the front extension support and locking mechanism 24 will now be described with reference to the above discussed figures as well as to FIGS. 2a, 3a, 4 and 5. When in the upright, sofa configuration, the front extension frame 92 may be either in a retracted position as shown in FIG. 2, or it may be extended forward of the front edge of the seat frame 48 as shown in FIG. 4. The front extension frame 92 is coupled to the seat frame 48 as well as to the carrier link 44 by means of the front extension support and locking mechanism 24.

As shown in the enlarged view of FIG. 2a, the front extension support and locking mechanism 24 includes a lock cover 68 coupled to a lateral portion of the seat frame 48 by means of a plurality of mounting pins 68a, 68b and 68c. Also a leg pivot bracket 74 is coupled to a lateral portion of the seat frame 48 by lock cover 68. The leg pivot bracket 74 is attached to lock cover 68 which in turn is attached to seat frame 48. The mounting pins 61 maintain the leg pivot bracket 74 in fixed relation to the seat frame 48. Pivotally attached to a lower end portion of the leg pivot bracket 74 by means of pivot pin 72 is an angle leg 82. When the bed is in a sleeping position, the angle leg 82 is oriented generally vertically and provides support for the distal edge portion of the seat frame 48 as well as for the front extension frame 92. The leg 82 moves with the seat/back hardware. The operation of the front extension mechanism 24 is independent of seat/back operation. In the sofa configuration as shown in FIGS. 2 and 2a, the angle leg 82 is withdrawn to a position within the U-shaped leg 20b and beneath the seat frame 48.

Also pivotally coupled to a lower end of the leg pivot bracket 74 is a boomerang-shaped bell crank 66. With an intermediate portion of the bell crank 66 pivotally coupled to the leg pivot bracket 74 and with one of its ends attached to the angle leg 82 by means of a coupling pin 65, pivoting displacement of the bell crank causes a corresponding pivoting displacement of the angle leg 82 about pivot pin 72. The other end of the bell crank 66 is connected by means of a pivot pin 67 to one end of a leg actuator link 64. The other end of the leg actuator link 64 is pivotally coupled to a triangular pivot link 62 by means of pivot pin 69. The triangular pivot link 62 is also coupled to an intermediate portion of a coupling link 60 by means of coupling pins 71 and 73. One end of the elongated, linear coupling link 60 is pivotally coupled by means of pivot pin 75 to the seat frame 48, while a second, opposed end of the coupling link is pivotally coupled to a forward end portion of the carrier link 44 by means of pivot pin 79. A forward portion of leg 20b is also securely coupled to a forward end portion of the carrier link 44 by means of coupling pins 81 and 83. Link 60 has a notch 60a which rests on a stop pin 44a in carrier link 44. When the sofa bed is in the sofa/sitting position.

Pivotally coupled to the lock cover 68 by means of pivot pin 63 is an elongated, linear lock link 80. One end of lock link 80 is pivotally coupled by means of a pivot pin 85 to a first end of a rear swing bracket 86. A second, opposed end of the rear swing bracket 86 is pivotally coupled to the front extender mount 90 by means of a pivot pin 87. Also pivotally coupled to the lock cover 68 by means of a pivot pin 93 is a curved swing link 84. The other end of the swing link 84 is pivotally coupled by means of a pivot pin 89 to a first end of a front swing bracket 88. A second, opposed end of the front swing bracket 88 is pivotally coupled to the extender mount 90 by means of a pivot pin 91. Opposed lateral edges of the front swing bracket 88 are provided with a notch 88a therein. The extender mount 90 is provided with a stop pin 97. Pin 95 pivotally connects links 86 and 84. With the front extension support and locking mechanism 24 in the fully retracted position as shown in FIGS. 2 and 2a, one notch 88a in the front swing bracket 88 receives and engages the stop pin 97 on the extender mount 90.

A bed extension lock link 70 is pivotally attached at one end thereof to the lock cover 68 by means of a pivot pin 99. A second, opposed end of the bed extension lock 70 is provided with an attachment pin 70a for coupling the bed extension lock to one end of a coil spring 76. The second end of the coil spring 76 is securely attached to a spring mount 77 extending from the lock cover 68. The coil spring 76 urges the bed extension lock 70 in a direction toward the spring mount 77 as shown in FIGS. 2 and 2a. When it is desired to move the front extension frame 92 from the retracted position to the extended position of FIGS. 4 and 5, the front extension frame is grasped and pulled forward and upward. As the front extension frame 92 is pulled forward and upward, lock link 80 coupled to the extender mount 90 by means of rear swing bracket 86 pivots in a clockwise direction about pin 63. As the lock link 80 pivots clockwise, its aft, or proximal end, engages the bed extension lock 70, urging the bed extension lock in a counter-clockwise direction of rotation about pivot pin 99. Continued extension of the front extension frame 92 and continued clockwise rotation of the lock link 80, which is provided with a notched end portion 80a, causes this notched end portion to engage a lower end portion of the bed extension lock 70. Secure engagement of the notched end portion 80a of the lock link 80 with the bed extension lock 70 locks the front extension frame 92 in the extended position as shown in FIG. 4. The front extension frame 92 is released from the locked extended configuration by lifting up the front extension frame so as to release the bed extension lock 70 from engagement with the lock link 80. This causes the coil spring 76 to align the bed extension lock 70 with the spring mount 77 as shown in FIGS. 2 and 2a and releases the lock link 80 which can then be rotated in a counter-clockwise direction to the retracted position.

As previously described, the sofa bed is moved from the sofa configuration to the bed configuration by grasping the forward, or distal, edge of the seat frame 48 and lifting in a forward direction causing the seat frame to move forward and the back frame 30 to pivot rearwardly and assume a generally horizontal orientation. As the seat frame 48 is moved forward, the angle leg 82 is automatically moved to a generally vertical orientation for supporting a forward portion of the seat frame 48. This is accomplished in the following manner.

As the forward edge of the seat frame 48 is raised and moved forward so as to traverse an upwardly extending arc, coupling link 60 is pivotally displaced about pivot pin 79 in a forward direction. This results in a corresponding forward displacement of pivot link 62 attached to coupling link 60 in a fixed manner. Pivot link 62 is not only displaced in a forward direction as the seat frame 48 is extended, but also is re-oriented from an upward pointing direction to a downward orientation. As the pivot link 62 is moved forward and re-oriented, leg actuator link 64, which is coupled at one end to the pivot link 62 by means of pivot pin 69, undergoes a corresponding forward and downward displacement. A second end of leg actuator link 64 as pivotally coupled to bell crank 66 by means of pivot pin 67 such that forward, downward displacement of the leg actuator link causes clockwise rotation of bell crank about pivot pin 72 which attaches the bell crank to the leg pivot bracket 74. Clockwise rotation of the bell crank 66 about pivot pin 72 causes a corresponding clockwise rotation of the angle leg 82 about pivot pin 72. In this manner, angle leg 82 is pivotally displaced about pivot pin 72 from the retracted position to a generally vertical orientation to provide support for a forward portion of the seat frame 48. The just described automatic extension of the angle leg 82 with forward displacement of the seat frame 48 is reversed by rearward displacement of a forward edge of the seat frame in automatically retracting the angle leg when the sofa bed is re-configured to the sofa configuration. The generally perpendicular alignment between the adjacent end of the leg actuator link 64 relative to the coupling link 60, which are coupled together by the pivot link 62, provides increased stability and strength of the angle leg when extended.

There has thus been shown a folding sofa bed which includes locking linkage for both a front extension frame when extended as well as for seat and back frames when reclined. The locking linkage arrangement further provides for the automatic extension of a support leg for the seat frame when the sofa bed is arranged in the sofa configuration. The locking linkage of the present invention facilitates re-configuration of the sofa bed between the sofa and bed configurations and ensures secure positioning of the seat, back and front extension frames when in either configuration.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A sofa bed comprising:

support means for supporting the sofa bed;

a back frame pivotally coupled to said support means and moveable between a generally upright position and a reclined, generally horizontal position;

a seat frame pivotally coupled to said support means and to said back frame and moveable between an inclined orientation with said back frame generally upright to form a sofa and a horizontal orientation with said back frame reclined to form a bed;

a forward extension; and locking linkage coupling said forward extension to said seat frame for pivotally displacing said forward extension between a horizontal orientation in alignment with said seat and back frames when in a bed configuration, and a generally vertical orientation below said seat frame in a sofa configuration, wherein said locking linkage includes first and second lock links pivotally coupled to said seat frame and wherein said first lock link includes a first end coupled to said forward extension and a second end having notch means for engaging said second lock link and preventing pivoting displacement of said first lock link so as to lock said forward extension in horizontal alignment with said seat and back frames.

2. The sofa bed of claim 1 further comprising a first pivoting backlink for coupling said back frame to said seat frame.

3. The sofa bed of claim 2 further comprising second and third pivoting backlinks for coupling said back frame to said support means.

4. The sofa bed of claim 1 further comprising latch means attached to said back frame for securely engaging said support means when in the bed configuration for locking the back and seat frames in a generally horizontal orientation adjacent to one another.

5. The sofa bed of claim 4 wherein said latch means includes a latch pin attached to said support means and a latch attached to said back frame for securely engaging said latch pin.

6. The sofa bed of claim 1 further comprising a support leg pivotally coupled to a forward portion of said seat frame for providing support for said seat frame when in the bed configuration.

7. The sofa bed of claim 6 further comprising pivoting linkage coupling said support leg to said seat frame and to said support means for automatically positioning said support leg in a generally vertical orientation below said seat frame when in the bed configuration and for retracting said support leg when the sofa bed is moved to the sofa configuration.

8. The sofa bed of claim 1 further comprising biasing means for urging said second lock link to a first position for engagement and pivoting displacement by said first lock link to a second position when said forward extension is moved to horizontal alignment with said seat and back frames, wherein said first lock link is engaged and locked in position by said second lock link.

9. The sofa bed of claim 8 wherein said biasing means includes a coil spring attached to said second lock link and to said seat frame.

10. The sofa bed of claim 8 wherein upon lifting of said forward extension, a said first lock link is disengaged from said second lock link, permitting said bias means to move second lock link from said second position toward said first position.

11. A sofa bed comprising:

support means for supporting the sofa bed;

a back frame pivotally coupled to said support means and moveable between a generally upright position and a generally horizontal, reclined position;

a seat frame pivotally coupled to said support means and moveable between an aft, inclined position and a forward, horizontal position aligned with said reclined back frame; and linkage coupling said back and seat frames for moving said back frame of the generally upright position when said seat frame is moved to the aft inclined position and for moving said back frame to the horizontal, reclined position when said seat frame is moved to the forward, horizontal position, said linkage includes locking means including a latch pin attached to said support means and a latch attached to said back frame for securely engaging said latch pin for locking said back and seat frames in the horizontal aligned position.

12. The sofa bed of claim 11 wherein said locking means is attached to said back frame for securely engaging said support means when in the bed configuration.

13. The sofa bed of claim 11 wherein said latch is L-shaped and includes a notch for receiving and engaging said latch pin.

14. The sofa bed of claim 13 further comprising a first pivoting backlink for coupling said back frame to said seat frame and wherein said L-shaped latch is coupled to said first pivoting backlink.

15. The sofa bed of claim 14 further comprising second and third pivoting backlinks for coupling said back frame to said support means.

16. The sofa bed of claim 15 further comprising a plurality of stop pins attached to said first pivoting backlink for engaging said second and third pivoting backlinks for securely maintaining said back frame in position in both the upright and reclined positions.

17. The sofa bed of claim 16 wherein said second and third pivoting backlinks each include at least one notch for receiving and engaging a respective stop pin on said first pivoting backlink.

18. The sofa bed of claim 11 further comprising pivoting linkage coupling said seat frame to said support means for displacing said seat frame forward when moved to the horizontal position and aft when moved to the inclined position.

19. The sofa bed of claim 11 further comprising a forward extension moveable between a horizontal orientation and alignment with said seat and back frames when in a bed configuration, and a generally vertical orientation below said seat frame when in a sofa configuration.

20. The sofa bed of claim 19 further comprising pivoting coupling linkage coupling said forward extension to said seat frame and to said support means.

* * * * *